US009598214B2

(12) United States Patent
Holley, Jr.

(10) Patent No.: US 9,598,214 B2
(45) Date of Patent: Mar. 21, 2017

(54) CARTON WITH ARTICLE PROTECTION FEATURES

(71) Applicant: GRAPHIC PACKAGING INTERNATIONAL, INC., Atlanta, GA (US)

(72) Inventor: John Murdick Holley, Jr., Lawrenceville, GA (US)

(73) Assignee: GRAPHIC PACKAGING INTERNATIONAL, INC., Atlanta, GA (US)

( * ) Notice: Subject to any disclaimer, the term of this patent is extended or adjusted under 35 U.S.C. 154(b) by 80 days.

(21) Appl. No.: 14/275,143

(22) Filed: May 12, 2014

(65) Prior Publication Data

US 2014/0332428 A1 Nov. 13, 2014

Related U.S. Application Data

(60) Provisional application No. 61/855,323, filed on May 13, 2013, provisional application No. 61/959,162,
(Continued)

(51) Int. Cl.
*B65D 71/38* (2006.01)
*B65D 5/44* (2006.01)
(Continued)

(52) U.S. Cl.
CPC ..... *B65D 71/38* (2013.01); *B65D 5/0281* (2013.01); *B65D 5/443* (2013.01); *B65D 5/445* (2013.01);
(Continued)

(58) Field of Classification Search
CPC ..... B65D 71/38; B65D 71/36; B65D 5/5002; B65D 5/5007; B65D 5/50; B65D 5/5009; B65D 5/5004
(Continued)

(56) References Cited

U.S. PATENT DOCUMENTS 1,925,102 A 9/1933 Levkoff
2,005,924 A 6/1935 Wilson
(Continued)

FOREIGN PATENT DOCUMENTS

CA 873185 6/1971
CA 2 610 666 5/2008
(Continued)

OTHER PUBLICATIONS

International Search Report and Written Opinion for PCT/US2014/037640 dated Sep. 12, 2014.
(Continued)

*Primary Examiner* — Andrew Perreault
(74) *Attorney, Agent, or Firm* — Womble Carlyle Sandridge & Rice, LLP

(57) ABSTRACT

A carton for holding a plurality of containers. The carton can comprise a plurality of panels that extends at least partially around an interior of the carton. The plurality of panels comprises a first top panel, a second top panel, and a side panel. The first top panel at least partially overlaps the second top panel. A crown retention panel can be foldably connected to the second top panel, and an attachment flap can be foldably connected to the crown retention panel. At least a portion of the crown retention panel can be spaced apart from the side panel in the interior of the carton, and at least a portion of the attachment flap can be at least partially in face-to-face contact with the side panel.

61 Claims, 8 Drawing Sheets

Related U.S. Application Data filed on Aug. 16, 2013, provisional application No. 61/963,653, filed on Dec. 10, 2013, provisional application No. 61/966,736, filed on Feb. 28, 2014.

(51) Int. Cl.

| | |
|---|---|
| ***B65D 5/02*** | (2006.01) |
| ***B65D 5/50*** | (2006.01) |
| ***B65D 71/36*** | (2006.01) |
| *B65B 5/02* | (2006.01) |

(52) U.S. Cl.

CPC ..... *B65D 5/5009* (2013.01); *B65D 71/36* (2013.01); *B65B 5/024* (2013.01); *B65D 2571/0032* (2013.01); *B65D 2571/0045* (2013.01); *B65D 2571/0066* (2013.01); *B65D 2571/00141* (2013.01); *B65D 2571/00308* (2013.01); *B65D 2571/00444* (2013.01); *B65D 2571/00524* (2013.01); *B65D 2571/00574* (2013.01); *B65D 2571/00666* (2013.01); *B65D 2571/00728* (2013.01); *B65D 2571/00814* (2013.01)

(58) Field of Classification Search

USPC ..... 340/568.1, 540, 500, 531, 572.1, 572.8; 235/462.01, 449, 492; 428/199; 426/118; 215/201, 251, 253, 307

See application file for complete search history.

(56) References Cited

U.S. PATENT DOCUMENTS

| | | | |
|---|---|---|---|
| 2,067,749 | A | 1/1937 | Zimmerman et al. |
| 2,115,673 | A | 4/1938 | Stompe |
| 2,196,502 | A | 4/1940 | Kells |
| 2,299,027 | A | 10/1942 | Novak |
| 2,386,905 | A | 10/1945 | Meitzen |
| 2,648,484 | A | 8/1953 | Belsinger |
| 2,669,351 | A | 2/1954 | Carson et al. |
| 2,754,047 | A | 7/1956 | Schmidt et al. |
| 3,078,032 | A | 2/1963 | Robinson et al. |
| 3,128,010 | A | 4/1964 | Forrer |
| 3,133,634 | A | 5/1964 | Bozdar |
| 3,173,596 | A | 3/1965 | Aust et al. |
| 3,178,242 | A | 4/1965 | Ellis et al. |
| 3,228,582 | A | 1/1966 | Osberg |
| 3,263,861 | A | 8/1966 | Carr |
| 3,265,283 | A | 8/1966 | Farquhar |
| 3,300,115 | A | 1/1967 | Schauer |
| 3,332,594 | A | 7/1967 | De Capua |
| 3,346,167 | A | 10/1967 | Schmidt |
| 3,356,279 | A | 12/1967 | Root |
| 3,517,858 | A | 6/1970 | Farquhar |
| 3,533,549 | A | 10/1970 | Gilchrist |
| 3,540,581 | A | 11/1970 | Koolnis |
| 3,825,170 | A | 7/1974 | Aust et al. |
| 3,904,036 | A | 9/1975 | Forrer |
| 4,155,449 | A | 5/1979 | Bryne |
| 4,214,660 | A | 7/1980 | Hunt, Jr. |
| 4,222,485 | A | 9/1980 | Focke |
| 4,256,226 | A | 3/1981 | Stone |
| 4,318,474 | A | 3/1982 | Hasegawa |
| 4,364,509 | A | 12/1982 | Holley, Jr. et al. |
| 4,375,258 | A | 3/1983 | Crayne et al. |
| 4,376,509 | A | 3/1983 | Schaffer |
| 4,378,877 | A | 4/1983 | Botterman et al. |
| 4,396,143 | A | 8/1983 | Killy |
| 4,417,655 | A | 11/1983 | Forbes, Jr. |
| 4,417,661 | A | 11/1983 | Roccaforte |
| 4,538,759 | A | 9/1985 | Dutcher |
| 4,577,762 | A | 3/1986 | Kuchenbecker |
| 4,588,084 | A | 5/1986 | Holley, Jr. |
| 4,605,128 | A | 8/1986 | Rieke |
| 4,621,766 | A | 11/1986 | McClure |
| 4,658,984 | A | 4/1987 | Brunner |
| 4,757,938 | A | 7/1988 | Collins |
| 4,817,866 | A | 4/1989 | Wonnacott |
| 4,830,267 | A | 5/1989 | Wilson |
| 4,890,440 | A | 1/1990 | Romagnoli |
| 4,949,845 | A | 8/1990 | Dixon |
| 4,967,901 | A | 11/1990 | Wood |
| 4,974,771 | A | 12/1990 | Lavery |
| 5,072,876 | A | 12/1991 | Wilson |
| 5,101,642 | A | 4/1992 | Alexandrov |
| 5,119,985 | A | 6/1992 | Dawson et al. |
| 5,137,211 | A | 8/1992 | Summer et al. |
| 5,219,229 | A | 6/1993 | Sengewald |
| 5,249,681 | A | 10/1993 | Miller |
| 5,261,594 | A | 11/1993 | Brown et al. |
| 5,297,725 | A | 3/1994 | Sutherland |
| 5,320,277 | A | 6/1994 | Stout et al. |
| 5,333,734 | A | 8/1994 | Stout et al. |
| 5,350,109 | A | 9/1994 | Brown et al. |
| 5,425,474 | A | 6/1995 | Dalea et al. |
| 5,482,185 | A | 1/1996 | McNaughton |
| 5,482,203 | A | 1/1996 | Stout |
| 5,505,372 | A | 4/1996 | Edson et al. |
| 5,577,612 | A | 11/1996 | Chesson et al. |
| 5,588,585 | A | 12/1996 | McClure |
| 5,597,114 | A | 1/1997 | Kramedjian et al. |
| 5,622,309 | A | 4/1997 | Matsuda et al. |
| 5,664,683 | A | 9/1997 | Brody |
| 5,690,213 | A | 11/1997 | Matsumura |
| 5,690,230 | A | 11/1997 | Griffith |
| 5,794,778 | A | 8/1998 | Harris |
| 5,826,783 | A | 10/1998 | Stout |
| 5,873,516 | A | 2/1999 | Boggs |
| 5,875,961 | A | 3/1999 | Stone et al. |
| 5,881,884 | A | 3/1999 | Podosek |
| 5,921,398 | A | 7/1999 | Carroll |
| 5,924,559 | A | 7/1999 | Carrel et al. |
| 5,927,498 | A | 7/1999 | Saam |
| 6,050,402 | A | 4/2000 | Walter |
| 6,149,009 | A | 11/2000 | Denola |
| 6,170,741 | B1 | 1/2001 | Skolik et al. |
| 6,176,419 | B1 | 1/2001 | Holley, Jr. |
| 6,250,542 | B1 | 6/2001 | Negelen |
| 6,283,293 | B1 | 9/2001 | Lingamfelter |
| 6,302,320 | B1 | 10/2001 | Stout |
| 6,409,077 | B1 | 6/2002 | Telesca et al. |
| D459,927 | S | 7/2002 | Flowers et al. |
| 6,471,120 | B1 | 10/2002 | Vogel |
| 6,478,219 | B1 | 11/2002 | Holley, Jr. |
| 6,484,903 | B2 | 11/2002 | Spivey et al. |
| 6,550,615 | B2 | 4/2003 | Lingamfelter |
| 6,557,699 | B1 | 5/2003 | Focke et al. |
| 6,578,736 | B2 | 6/2003 | Spivey |
| 6,604,677 | B1 | 8/2003 | Sutherland et al. |
| 6,631,803 | B2 | 10/2003 | Rhodes et al. |
| 6,669,083 | B2 | 12/2003 | Bates |
| 6,715,639 | B2 | 4/2004 | Spivey |
| 6,752,262 | B1 | 6/2004 | Boriani et al. |
| 6,766,940 | B2 | 7/2004 | Negelen |
| 6,789,673 | B2 | 9/2004 | Lingamfelter |
| 6,848,573 | B2 | 2/2005 | Gould et al. |
| 6,866,186 | B2 | 3/2005 | Fogle et al. |
| 6,902,104 | B2 | 6/2005 | Holley, Jr. et al. |
| 6,905,066 | B2 | 6/2005 | Holley, Jr. |
| 6,918,487 | B2 | 7/2005 | Harrelson |
| 6,926,193 | B2 | 8/2005 | Smalley |
| 6,929,172 | B2 | 8/2005 | Bates et al. |
| 6,932,265 | B2 | 8/2005 | Sax et al. |
| 6,968,992 | B2 | 11/2005 | Schuster |
| 6,969,172 | B2 | 11/2005 | Actis-Datta |
| 6,974,072 | B2 | 12/2005 | Harrelson |
| 6,991,107 | B2 | 1/2006 | Harrelson |
| 6,997,316 | B2 | 2/2006 | Sutherland |
| 7,000,803 | B2 | 2/2006 | Miller |
| 7,073,665 | B2 | 7/2006 | Auclair et al. |
| 7,104,435 | B2 | 9/2006 | Holley, Jr. |
| 7,134,593 | B2 | 11/2006 | Harrelson |
| 7,159,759 | B2 | 1/2007 | Sutherland et al. |
| 7,225,930 | B2 | 6/2007 | Ford et al. |

(56) References Cited

U.S. PATENT DOCUMENTS

| | | | |
|---|---|---|---|
| 7,422,104 | B2 | 9/2008 | Perkinson |
| 7,478,743 | B2 | 1/2009 | Holley, Jr. |
| 7,604,157 | B2 | 10/2009 | Zammit et al. |
| 7,699,163 | B2 | 4/2010 | Gomes et al. |
| 7,699,215 | B2 | 4/2010 | Spivey, Sr. |
| 8,356,743 | B2 | 1/2013 | Spivey, Sr. |
| 8,387,855 | B2 | 3/2013 | Brand |
| 8,439,194 | B2 | 5/2013 | Spivey |
| 8,453,919 | B2 | 6/2013 | Eckermann |
| 8,496,109 | B2 | 7/2013 | Smalley |
| 8,919,557 | B2 | 12/2014 | Spivey, Sr. |
| 8,955,674 | B2 | 2/2015 | Spivey, Sr. |
| 8,967,380 | B2 | 3/2015 | Moncrief et al. |
| 2001/0017315 | A1 | 8/2001 | Baroudi |
| 2002/0029991 | A1 | 3/2002 | Lingamfelter |
| 2002/0070139 | A1 | 6/2002 | Bates |
| 2002/0088820 | A1 | 7/2002 | Spivey |
| 2002/0088821 | A1 | 7/2002 | Spivey et al. |
| 2002/0185499 | A1 | 12/2002 | Harrelson et al. |
| 2003/0006158 | A1 | 1/2003 | Skolik et al. |
| 2003/0136820 | A1 | 7/2003 | Negelen |
| 2003/0141313 | A1 | 7/2003 | Bates |
| 2003/0150759 | A1 | 8/2003 | White, Jr. |
| 2003/0192907 | A1 | 10/2003 | Bates |
| 2004/0040334 | A1 | 3/2004 | Rusnock |
| 2004/0060972 | A1 | 4/2004 | Harrelson |
| 2004/0089575 | A1 | 5/2004 | Lingamfelter |
| 2004/0089671 | A1 | 5/2004 | Miller |
| 2004/0099558 | A1 | 5/2004 | Oliff et al. |
| 2004/0155098 | A1 | 8/2004 | Harrelson |
| 2004/0188277 | A1 | 9/2004 | Auclair |
| 2004/0188300 | A1 | 9/2004 | Sutherland |
| 2004/0188508 | A1 | 9/2004 | Holley, Jr. et al. |
| 2005/0023170 | A1 | 2/2005 | Lingamfelter |
| 2005/0092820 | A1 | 5/2005 | Chekroune |
| 2005/0115843 | A1 | 6/2005 | Harrelson |
| 2005/0126947 | A1 | 6/2005 | Holley, Jr. |
| 2005/0167291 | A1 | 8/2005 | Sutherland |
| 2005/0167478 | A1 | 8/2005 | Holley, Jr. |
| 2005/0189405 | A1 | 9/2005 | Gomes et al. |
| 2005/0263574 | A1 | 12/2005 | Schuster |
| 2006/0054522 | A1 | 3/2006 | Kline et al. |
| 2006/0081691 | A1 | 4/2006 | Smalley |
| 2006/0091193 | A1 | 5/2006 | DeBusk |
| 2006/0118606 | A1 | 6/2006 | Holley, Jr. et al. |
| 2006/0131370 | A1 | 6/2006 | Bates |
| 2006/0175386 | A1 | 8/2006 | Holley, Jr. |
| 2006/0231441 | A1 | 10/2006 | Gomes |
| 2006/0231600 | A1 | 10/2006 | Holley, Jr. |
| 2006/0249413 | A1 | 11/2006 | Auclair et al. |
| 2006/0278689 | A1 | 12/2006 | Boshinski et al. |
| 2007/0007325 | A1 | 1/2007 | Suzuki et al. |
| 2007/0029371 | A1 | 2/2007 | Theelen |
| 2007/0108261 | A1 | 5/2007 | Schuster |
| 2007/0131748 | A1 | 6/2007 | Brand |
| 2007/0164093 | A1 | 7/2007 | Spivey et al. |
| 2007/0181658 | A1 | 8/2007 | Sutherland |
| 2007/0205255 | A1 | 9/2007 | Dunn |
| 2007/0210144 | A1 | 9/2007 | Brand |
| 2007/0251982 | A1 | 11/2007 | Brand |
| 2007/0295790 | A1 | 12/2007 | Zammit et al. |
| 2008/0023535 | A1 | 1/2008 | Holley, Jr. |
| 2008/0048014 | A1 | 2/2008 | Bates |
| 2008/0128479 | A1 | 6/2008 | Bates et al. |
| 2008/0257944 | A1 | 10/2008 | Blin |
| 2009/0282843 | A1 | 11/2009 | Brand |
| 2010/0044420 | A1 | 2/2010 | Brand et al. |
| 2010/0122999 | A1 | 5/2010 | Brand |
| 2010/0237138 | A1 | 9/2010 | Bradford |
| 2011/0011924 | A1 | 1/2011 | Spivey et al. |
| 2011/0049228 | A1 | 3/2011 | Brand |
| 2011/0068160 | A1 | 3/2011 | Brand et al. |
| 2011/0290692 | A1 | 12/2011 | Spivey, Sr. |
| 2012/0091021 | A1 | 4/2012 | Smalley |
| 2013/0118942 | A1 | 5/2013 | Smalley et al. |
| 2013/0119122 | A1 | 5/2013 | Spivey, Sr. |
| 2013/0277260 | A1 | 10/2013 | Smalley et al. |
| 2013/0284628 | A1 | 10/2013 | Moncrief et al. |
| 2013/0292285 | A1 | 11/2013 | Kastanek |
| 2014/0260095 | A1 | 9/2014 | Oliveira |

FOREIGN PATENT DOCUMENTS

| | | |
|---|---|---|
| EP | 0 066 029 | 12/1982 |
| EP | 1 433 714 | 6/2004 |
| EP | 1 698 565 | 9/2009 |
| FR | 2 549 010 | 1/1985 |
| GB | 2 264 101 | 8/1993 |
| JP | 2002-128064 | 5/2002 |
| JP | 2005-255224 A | 9/2005 |
| JP | 2006-111342 | 4/2006 |
| JP | 2007-055630 | 3/2007 |
| JP | 2007-532421 | 11/2007 |
| JP | 2010-149927 | 7/2010 |
| KR | 10-0154124 | 2/1999 |
| KR | 10-0371048 | 8/2003 |
| WO | WO 96/21603 | 7/1996 |
| WO | WO 96/29260 | 9/1996 |
| WO | WO 99/28198 | 6/1999 |
| WO | WO 99/64301 | 12/1999 |
| WO | WO 00/03937 | 1/2000 |
| WO | WO 02/47990 | 6/2002 |
| WO | WO 2004/043790 | 5/2004 |
| WO | WO 2005/051781 | 6/2005 |
| WO | WO 2005/100175 | 10/2005 |
| WO | WO 2006/050210 | 5/2006 |
| WO | WO 2006/050316 | 5/2006 |
| WO | WO 2007/076544 | 7/2007 |

OTHER PUBLICATIONS

International Search Report and Written Opinion for PCT/US2014/037655 dated Sep. 4, 2014.

International Search Report and Written Opinion for PCT/US2014/037656 dated Sep. 4, 2014.

International Search Report and Written Opinion for PCT/US2014/069472 dated Apr. 1, 2015.

International Search Report and Written Opinion for PCT/US2015/017959 dated Jun. 16, 2015.

CARTON WITH ARTICLE PROTECTION FEATURES

CROSS-REFERENCE TO RELATED APPLICATIONS

This application claims the benefit of U.S. Provisional Patent Application No. 61/855,323, filed May 13, 2013, U.S. Provisional Patent Application No. 61/959,162, filed Aug. 16, 2013, U.S. Provisional Patent Application No. 61/963,653, filed Dec. 10, 2013, and U.S. Provisional Patent Application No. 61/966,736, filed Feb. 28, 2014.

INCORPORATION BY REFERENCE

The disclosures of U.S. Provisional Patent Application No. 61/855,323, which was filed on May 13, 2013, U.S. Provisional Patent Application No. 61/855,305, which was filed on May 13, 2013, U.S. Provisional Patent Application No. 61/959,162, which was filed on Aug. 16, 2013, U.S. Provisional Patent Application No. 61/963,653, which was filed on Dec. 10, 2013, U.S. Provisional Patent Application No. 61/966,736, which was filed on Feb. 28, 2014, U.S. patent application Ser. No. 14/274,975, which was filed on May 12, 2014, U.S. patent application Ser. No. 13/419,740, which was filed on Mar. 14, 2012, U.S. patent application Ser. No. 13/768,079, which was filed on Feb. 15, 2013, and U.S. patent application Ser. No. 13/833,542, which was filed on Mar. 15, 2013, are hereby incorporated by reference for all purposes as if presented herein in their entirety.

BACKGROUND OF THE DISCLOSURE

The present disclosure generally relates to cartons for holding beverage containers or other types of articles. More specifically, the present disclosure relates to cartons having article protection features.

SUMMARY OF THE DISCLOSURE

In general, one aspect of the disclosure is directed to a carton for holding a plurality of containers. The carton can comprise a plurality of panels that extends at least partially around an interior of the carton. The plurality of panels comprises a first top panel, a second top panel, and a side panel. The first top panel at least partially overlaps the second top panel. A crown retention panel can be foldably connected to the second top panel, and an attachment flap can be foldably connected to the crown retention panel. At least a portion of the crown retention panel can be spaced apart from the side panel in the interior of the carton, and at least a portion of the attachment flap can be at least partially in face-to-face contact with the side panel.

In another aspect, the disclosure is generally directed to a blank for forming a carton for holding a plurality of containers. The blank can comprise a plurality of panels comprising a first top panel, a second top panel, and a side panel. The first top panel is for at least partially overlapping the second top panel when the carton is formed from the blank. A crown retention panel can be foldably connected to the second top panel, and an attachment flap can be foldably connected to the crown retention panel. At least a portion of the crown retention panel is for being disposed in a position that is spaced apart from the side panel when the carton is formed from the blank, and at least a portion of the attachment flap is for being disposed at least partially in face-to-face contact with the side panel when the carton is formed from the blank.

In another aspect, the disclosure is generally directed to a method of forming a carton for holding a plurality of containers. The method comprising obtaining a blank comprising a plurality of panels comprising a first top panel, a second top panel, a side panel, a crown retention panel foldably connected to the second top panel, and an attachment flap foldably connected to the crown retention panel, folding the blank so that the crown retention panel is at least partially in face-to-face contact with the side panel and at least partially affixing the attachment flap to the side panel, positioning the first top panel to at least partially overlap the second top panel, and forming an interior of the carton at least partially defined by the plurality of panels. The forming the interior of the carton comprising forming an open-ended sleeve, and the forming the interior of the carton causing the crown retention panel to fold relative to the second top panel and to be disposed in a position that is spaced apart from the side panel in the interior of the carton.

Those skilled in the art will appreciate the above stated advantages and other advantages and benefits of various additional embodiments reading the following detailed description of the embodiments with reference to the below-listed drawing figures. It is within the scope of the present disclosure that the above-discussed aspects be provided both individually and in various combinations.

BRIEF DESCRIPTION OF THE DRAWINGS

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION OF THE EXEMPLARY EMBODIMENTS

The present disclosure generally relates to cartons that contain articles such as containers, bottles, cans, etc. The articles can be used for packaging food and beverage products, for example. The articles can be made from materials suitable in composition for packaging the particular food or beverage item, and the materials include, but are not limited to, aluminum and/or other metals; glass; plastics such as PET, LDPE, LLDPE, HDPE, PP, PS, PVC, EVOH, and Nylon; and the like, or any combination thereof.

Cartons according to the present disclosure can accommodate articles of any shape. For the purpose of illustration and not for the purpose of limiting the scope of the disclosure, the following detailed description describes beverage containers (e.g., glass beverage bottles) as disposed within the carton embodiments. In this specification, the terms "inner," "interior," "outer," "exterior," "lower," "bottom," "upper," and "top" indicate orientations determined in relation to fully erected and upright cartons.

Figure 1:
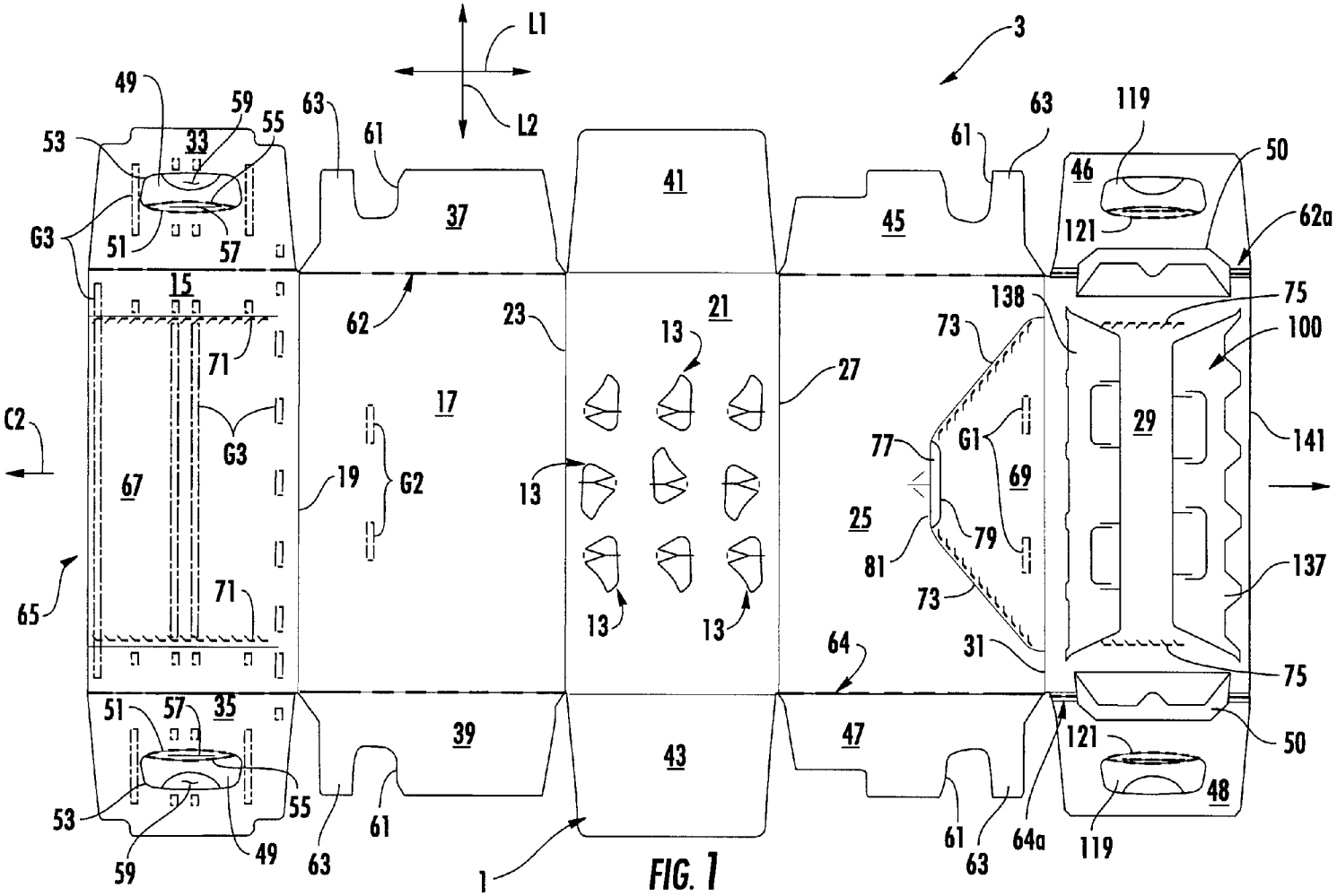
FIG. 1 is a plan view of a carton blank used to form a carton according to an exemplary embodiment of the disclosure.
Figure 7:
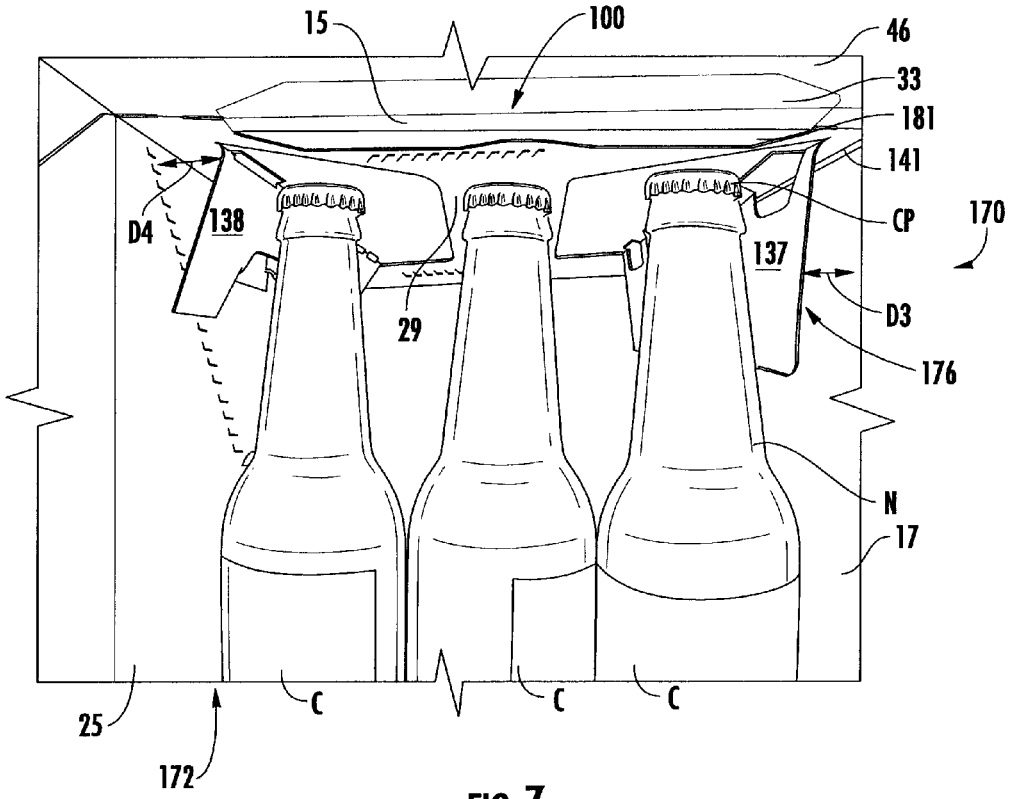

FIG. 1 is a plan view of an interior surface 1 of a carton blank, generally indicated at 3, used to form a carton 5 (FIG. 9) according to the exemplary embodiment of the disclosure. The carton 5 can be used to house a plurality of articles such as containers C with necks or upper portions N that are generally narrower than the lower portions of the containers (FIG. 7). The containers C can include tops or caps CP (FIG. 7). In the illustrated embodiment, the carton 5 is sized to house eighteen containers C in a single layer in a 3×6 arrangement, but it is understood that the carton 5 may be sized and shaped to hold containers of a different or same quantity in more than one layer and/or in different row/column arrangements (e.g., 1×6, 3×4, 2×6×2, 3×5, 4×5, 2×9, 2×6, 4×4, etc.). As shown in FIG. 1, the carton blank 3 can include integrated crown retention features 100 in a second top panel. The carton 5 can include a dispenser 10 (FIGS. 5 and 9) for allowing access to the containers C. In the illustrated embodiment, the carton 5 includes first and second handles 11 (FIGS. 8 and 9) for grasping and carrying the carton at a respective first end 7 and second end 9 of the carton. As will be discussed below in more detail, the handles 11 are formed from various features in the blank 3.

The blank 3 and carton 5 can have features that are similar or identical to the features described in any of the embodiments disclosed in the above-noted incorporated by reference patent applications, including U.S. patent application Ser. No. 13/419,740, U.S. Provisional Patent Application No. 61/855,305, and all related applications. Accordingly, in one embodiment, the carton 5 may have article protection flaps 13 for protecting the at least one article. As noted in the incorporated by reference applications, the article protection flaps 13 are moveable between a first position and a second position placed between adjacent containers C in the carton to reduce movement of the containers in the carton and prevent breakage of the containers. The carton 5 can have other features (e.g., article protection features in the ends 7, 9 of the carton 5 for cushioning one or more of the containers C) without departing from the disclosure.

The carton blank 3 has a longitudinal axis L1 and a lateral axis L2. The carton blank 3 can include a longitudinal centerline C2, as shown in FIG. 1. In the illustrated embodiment, the blank 3 comprises a first or outer top panel 15 foldably connected to a first side panel 17 at a first lateral fold line 19. A bottom panel 21 is foldably connected to the first side panel 17 at a second lateral fold line 23. A second side panel 25 is foldably connected to the bottom panel 21 at a third lateral fold line 27. A second or inner top panel 29 is foldably connected to the second side panel 25 at a fourth lateral fold line 31. Any of the top and bottom panels 15, 29, 21 and the first and second side panels 17, 25 can be otherwise shaped, arranged, configured, or omitted, without departing from the disclosure.

The first top panel 15 is foldably connected to a first top end flap 33 and a second top end flap 35. The first side panel 17 is foldably connected to a first side end flap 37 and a second side end flap 39. The bottom panel 21 is foldably connected to a first bottom end flap 41 and a second bottom end flap 43. The second side panel 25 is foldably connected to a first side end flap 45 and a second side end flap 47. The second top panel 29 is foldably connected to a first top end flap 46 and a second top end flap 48. When the carton 5 is erected, the top and bottom end flaps 33, 46, and 41 and side end flaps 37 and 45 close the first end 7 of the carton, and the top and bottom end flaps 35, 48, and 43 and side end flaps 39 and 47 close the second end 9 of the carton. In accordance with an alternative embodiment of the present disclosure, different flap arrangements can be used for at least partially closing the ends 7, 9 of the carton 5.

In one embodiment, the top and bottom end flaps 33, 46, and 41 and side end flaps 37 and 45 extend along a first marginal area of the blank 3, and are foldably connected at a first longitudinal fold line 62 that extends along the length of the blank. In the illustrated embodiment, the top and bottom end flaps 35, 48, and 43 and side end flaps 39 and 47 extend along a second marginal area of the blank 3, and are foldably connected at a second longitudinal fold line 64 that also extends along the length of the blank. The longitudinal fold lines 62, 64 may be, for example, substantially straight, or offset at one or more locations to account for blank thickness or for other factors. In the illustrated embodiment, a portion of the first longitudinal fold line 62 comprises a fold line or area 62*a* connecting the first top end flap 46 to the second top panel 29, and a portion of the second longitudinal fold line 64 comprises fold line or area 64*a* connecting the second top end flap 48 to the second top panel 29. In the one embodiment, each of the fold areas 62*a*, 64*a* can include several fold lines (e.g., scores, creases, cut-crease lines, etc.). Alternatively, the fold areas 62*a*, 64*a* can be other lines or areas of weakening for folding the top end flaps 46, 48 relative to the second top panel 29 (e.g., a single fold line). Openings 50 can interrupt the fold areas 62*a*, 64*a* to help avoid bunching of the blank material when the overlapping top end flaps are folded at the overlapping portions of the longitudinal fold lines in the erected carton 5.

As shown in FIG. 1, the features that form the handles 11 of the carton 5 include elongate outer handle flaps 49 formed in the respective top end flaps 33, 35 and foldably attached to the respective top end flap at a respective arcuate fold line 51. The handle flaps 49 are separable from the respective top end flaps 33, 35 at a respective cut or tear line 53. An opposing arcuate fold line 55 can extend in each of the handle flaps 49 adjacent or proximate the respective arcuate fold lines 51, and a longitudinal score 57 can extend between the opposing arcuate fold lines 51, 55 in each of the handle flaps. In one embodiment, each of the handle flaps 49 can have an edge (e.g., a curved edge) that is adjacent a cutout 59. Additionally, an inner handle flap 119 can be formed in each of the respective top end flaps 46, 48 and can be foldably attached to the respective top end flap at a respective arcuate fold line 121. The inner handle flaps 119 can be similar or identical to the respective outer handle flaps 49 (e.g., with fold lines 51, 55, 57, and cutouts 59 so that the inner and outer handle flaps, fold lines, and cutouts are generally aligned and/or are overlapped with respect to one another in the handles 11 in the erected carton 5. The features that form the handles 11 further include cutouts 61 in the respective side end flaps 37, 45, 39, 47. The side end flaps 37, 45, 39, 47 can also include respective upper portions 63 disposed above the respective cutouts 61. One of the handles 11 could have different features than the other handle or could be omitted without departing from the disclosure. One or both of the handles 11 could be otherwise shaped, arranged, and/or configured without departing from the disclosure.

According to the illustrated embodiment, the dispenser 10 comprises a dispenser pattern 65 including a first dispenser panel 67 in the first top panel 15 and a second dispenser panel 69 in the second side panel 25 and the second top panel 29. In the illustrated embodiment, the first dispenser panel 67 can include two longitudinal tear lines 71 in the first top panel 15. In one embodiment, the first dispenser panel 67 could be foldably connected to the first top panel 15 along a lateral fold or tear line in the first top panel 15 (not shown). The second dispenser panel 69 can include two oblique tear lines 73 in the second side panel 25 and two longitudinal tear lines 75 in the second top panel 29. The second dispenser panel 69 can also include an access panel 77 in the second side panel 25. The access panel 77 can be foldably connected to the second dispenser panel 69 along a lateral fold line 79 and can be separable from the second dispenser panel 69 and the second side panel 25 along a tear or cut line 81. In one embodiment, the first dispenser panel 67 can at least partially overlap the portion of the second dispenser panel 69 in the second top panel so that the overlapped dispenser panels can be separable from the second side panel 25 and the top panels 15, 29 along the tear lines 73, 71, 75 to form a dispenser opening (not shown) in the carton 5 to provide access to the containers C within the carton. The access panel 77 can help initiate tearing along the tear lines by folding inwardly along the fold line 79 to form an access opening (not shown) capable of receiving a hand, fingers, etc., so that a user can grip the second dispenser panel 69 adjacent the access panel 77 and pull the overlapped dispenser panels 67, 69 outwardly from the carton 5. The dispenser pattern 65 could be omitted or could be otherwise shaped, arranged, and/or configured without departing from the disclosure.

In the illustrated embodiment, the bottom panel 21 includes nine article protection flaps 13 foldably connected to the bottom panel and arranged in a 3×3 array generally centered in the bottom panel. The article protection flaps can be similar to, or the same as, those described in U.S. Provisional Patent Application No. 61/855,305 filed on May 13, 2013, the disclosure of which is hereby incorporated by reference for all purposes as if presented herein in its entirety. The article protection flaps 13 could be omitted or could be otherwise shaped, arranged, positioned, and/or configured without departing from the disclosure.

Figure 2:
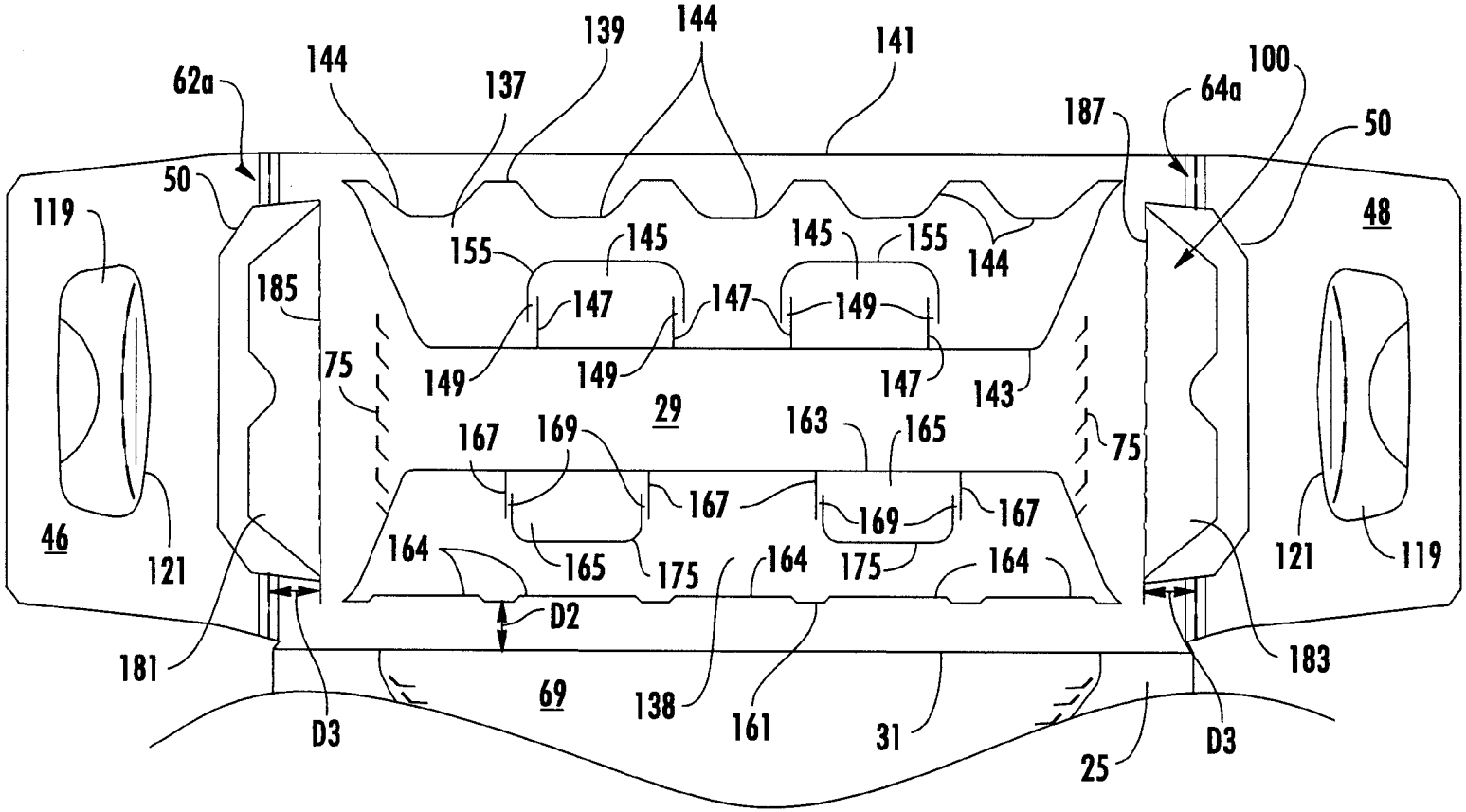
FIG. 2 is a detail plan view of a second top panel of the blank of FIG. 1 according to the exemplary embodiment of the disclosure.

In the illustrated embodiment, the second top panel 29 can include the crown retention features 100 for helping to retain the upper portions of the containers C in the carton 5. As shown in FIGS. 1 and 2, the crown retention features 100 can include a first inner side panel or crown retention panel 137 and a second inner side panel or crown retention panel 138, each of which can be included in the second top panel 29. As shown in FIGS. 1 and 2, the first crown retention panel 137 is foldably connected to the second top panel 29 along a lateral fold line 139 that is spaced apart from a free edge 141 of the blank 3. In the illustrated embodiment, the lateral fold line 139 can be spaced apart from the first side panel 17 by a distance D1 (FIGS. 4 and 6-8) when the carton 5 is formed. In one embodiment, the distance between the lateral fold line 139 and the free edge 141 can be less than the distance D1 and the edge 141 can be spaced apart from the fold line 19 and the first side panel 17 when the top panels 15, 29 are overlapped to form the carton (FIGS. 6-8) so that the lateral fold line 139 is spaced apart from the first side panel 17 by the distance D1. The first crown retention panel 137 can be separable from the second top panel 29 along a tear or cut line 143 and generally U-shaped cut lines 144, which can interrupt the lateral fold line 139. In the illustrated embodiment, the first crown retention panel 137 includes two attachment flaps 145, each of which can be defined by two longitudinal cuts 147 and a generally U-shaped cut 155 in the first crown retention panel 137. The attachment flaps 145 also can be defined by the cut line 143. The longitudinal cuts 147 can extend from the cut line 143 and can be spaced apart from the U-shaped cut 155 so that a connecting portion 149 is formed between each of the longitudinal cuts 147 and the respective ends of the U-shaped cuts 155. Accordingly, the connecting portions 149 can foldably connect the respective attachment flaps 145 to the first crown retention panel 137. The first crown retention panel 137 and/or the attachment flaps 145 could be otherwise shaped, arranged, and/or configured without departing from the disclosure. For example, the first crown retention panel 137 could include any suitable number of attachment flaps 145 (e.g., one or more than two). Additionally, one or both of the attachment flaps 145 and/or the first crown retention panel 137 could be rotated with respect to the orientation shown in FIGS. 1 and 2. Further, one or both of the attachment flaps could be spaced apart from the cut line 143 and/or the attachment flaps could be connected to the crown retention panel 137 along one or more fold lines.

Similarly, as shown in FIGS. 1 and 2, the second crown retention panel 138 is foldably connected to the second top panel 29 along a lateral fold line 161 that is spaced apart from the lateral fold line 31 by a distance D2. The second crown retention panel 138 can be separable from the second top panel 29 along a tear or cut line 163 and generally U-shaped cut lines 164, which can interrupt the lateral fold line 161. As shown in FIG. 2, the tear lines 75 can extend from the cut line 163 of the second article protection flap 138 in one embodiment. In the illustrated embodiment, the second crown retention panel 138 includes two attachment flaps 165, each of which can be defined by two longitudinal cuts 167 and a generally U-shaped cut 175 in the second crown retention panel 138. The attachment flaps 165 also can be defined by the cut line 163. The longitudinal cuts 167 can extend from the cut line 163 and can be spaced apart from the U-shaped cut 175 so that a connecting portion 169 is formed between each of the longitudinal cuts 167 and the respective ends of the U-shaped cuts 175. Accordingly, the connecting portions 169 can foldably connect the respective attachment flaps 165 to the second crown retention panel 138. In the illustrated embodiment, the connecting portions 149 are interior to the respective U-shaped cuts 155, and the connecting portions 169 are exterior to the respective U-shaped cuts 175; however, the connecting portions 149, 169, the longitudinal cuts 147, 167, and/or the U-shaped cuts 155, 175 could be otherwise shaped, arranged, and/or configured without departing from the disclosure. Additionally, the second crown retention panel 138 and/or the attachment flaps 165 could be otherwise shaped, arranged, and/or configured without departing from the disclosure. For example, the second crown retention panel 138 could be different than or substantially identical to the first crown retention panel 137. Additionally, one or both of the crown retention panels 137, 138 could be omitted without departing from the disclosure. Further, one or more of the U-shaped cut lines 144, 164 could be omitted.

In the illustrated embodiment, the crown retention features 100 also can include a first crown retention end flap 181 and a second crown retention end flap 183, each foldably connected to the second top panel 29 along a respective longitudinal fold line 185, 187 adjacent a respective opening 50. As shown in FIG. 2, the longitudinal fold lines 185, 187 can be spaced apart from the respective fold areas 62*a*, 64*a* by a distance D3. The crown retention end flaps 181, 183 could be otherwise shaped, arranged, and/or configured without departing from the disclosure. Further, one or both of the crown retention end flaps 181, 183 could be omitted without departing from the disclosure.

Figure 3:
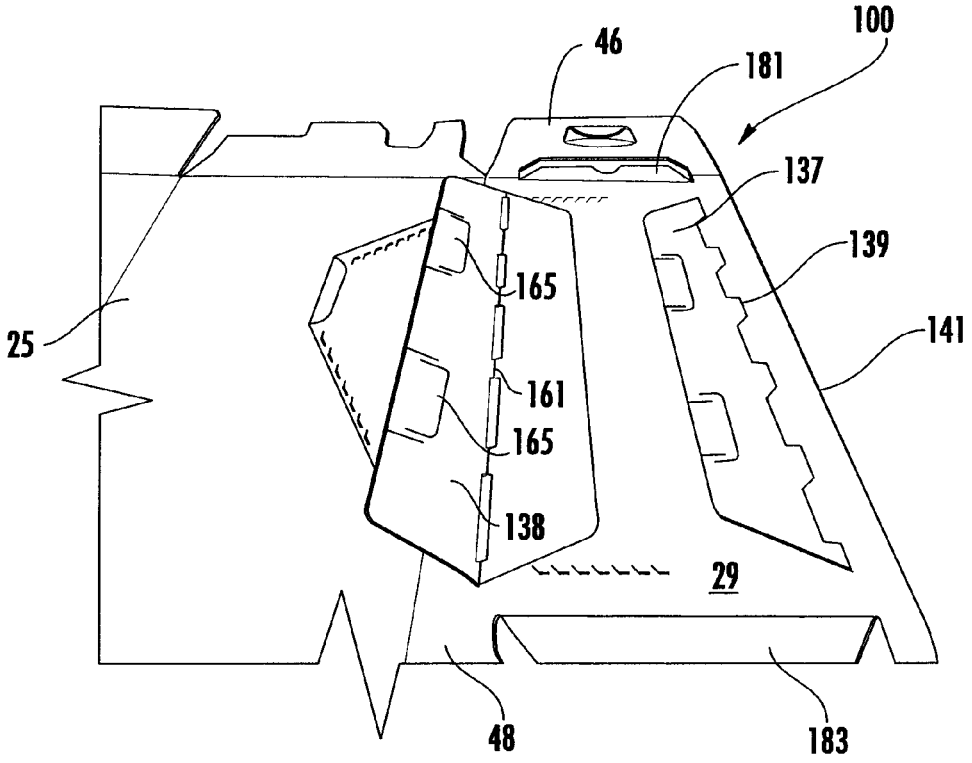
FIGS. 3-8 are perspective views showing steps of forming a partially-erected carton according to the exemplary embodiment of the disclosure.
Figure 4:
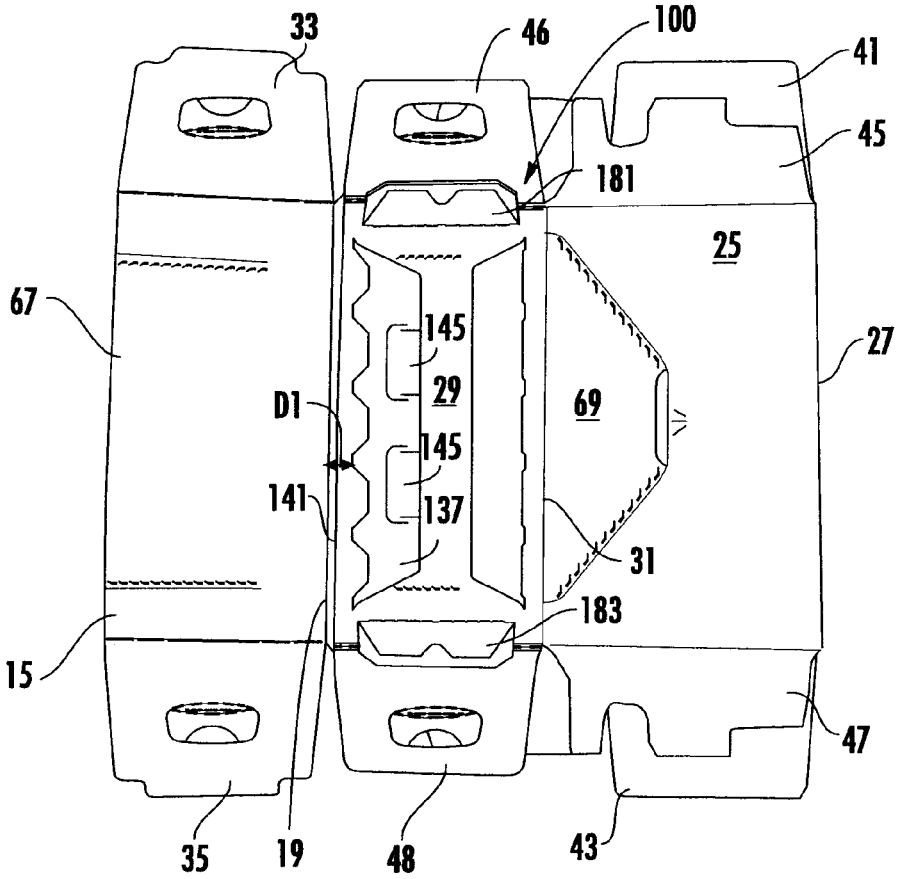

As shown in FIGS. 3-8, in one exemplary embodiment, the carton 5 can be assembled by initially folding the second crown retention panel 138 along the lateral fold line 161 so that the second crown retention panel 138 at least partially separates from the second top panel 29 along the cut lines 163, 164 and at least partially forms an opening in the second top panel 29 (FIG. 3). In one embodiment, the tear lines 75 in the second top panel 29 extend from an inner edge of the second top panel adjacent the opening formed by the folding of the second crown retention panel 138. The second crown retention panel can be positioned in face-to-face contact with the second side panel 25 as shown in FIGS. 3 and 4. In one embodiment, the attachment flaps 165 of the second crown retention panel 138 can be adhered with glue strips G1 (FIG. 1), for example, to the interior surface of the portion of the second dispenser panel 69 in the second side panel 25 (e.g., between the oblique tear lines 73). As shown in FIG. 4, the carton blank 3 can be folded along the lateral fold line 27 so that the second top panel 29 and the second side panel 25 generally overlap the first side panel 17 and the bottom panel 21 and the edge 141 of the second top panel 29 is disposed proximate the lateral fold line 19. In the illustrated embodiment, the attachment flaps 145 of the first crown retention panel 137 can be adhered with glue strips G2 (FIG. 1), for example, to the interior surface of the first side panel 17. As shown in FIGS. 3 and 4, the folding of the second crown retention panel 138

Figure 5:
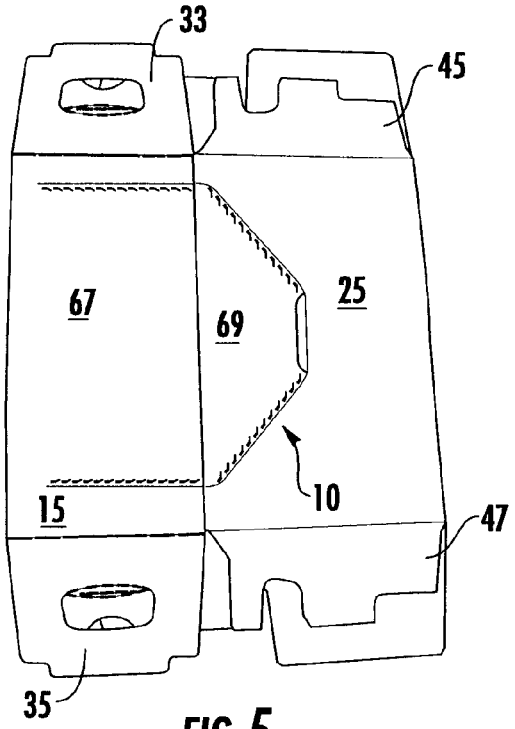

As shown in FIG. 5, the first top panel 15 can be folded along the lateral fold line 19 so that the first top panel 15 is at least partially in face-to-face contact with the second top panel 29 and top end flaps 33, 35 are at least partially in face-to-face contact with the respective top end flaps 46, 48. The fold areas 62*a*, 64*a* generally can be aligned with the portions of the respective longitudinal fold lines 62, 64 connecting the respective top end flaps 33, 35 to the first top panel 15. In the illustrated embodiment, the top panels 15, 29 can be positioned so that the lateral fold line 161 connecting the second crown retention panel 138 to the second top panel 29 is spaced apart from the lateral fold line 31 and the second side panel 25 by at least the distance D2 (FIGS. 2, 6, and 7) and the lateral fold line 139 connecting the first crown retention panel 137 to the second top panel 29 is spaced apart from the lateral fold line 19 and the first side panel 17 by at least a distance D1 (FIGS. 4 and 6-8). The top panels 15, 29 could be otherwise overlapped and positioned relative to one another without departing from the scope of this disclosure.

In the illustrated embodiment, the second top panel 29 can be glued to the interior surface of the first top panel 15, and the top end flaps 46, 48 can be glued to the respective top end flaps 33, 35, such as by glue strips G3 (e.g., as shown in FIG. 1). In one embodiment, the first crown retention panel 137 and the crown retention end flaps 181, 183 are not glued to the first top panel 15 so that the first crown retention panel and the crown retention end flaps can be positioned independently of the top panels 15, 29. In the illustrated embodiment, when the top end flaps 46, 48 are glued to the respective top end flaps 33, 35, the outer handle flaps 49 at least partially overlap and/or are generally aligned with the inner handle flaps 119. In the illustrated embodiment, the first dispenser panel 67 in the first top panel 15 can be glued to the portion of the second dispenser panel 69 in the second top panel 29.

Figure 6:
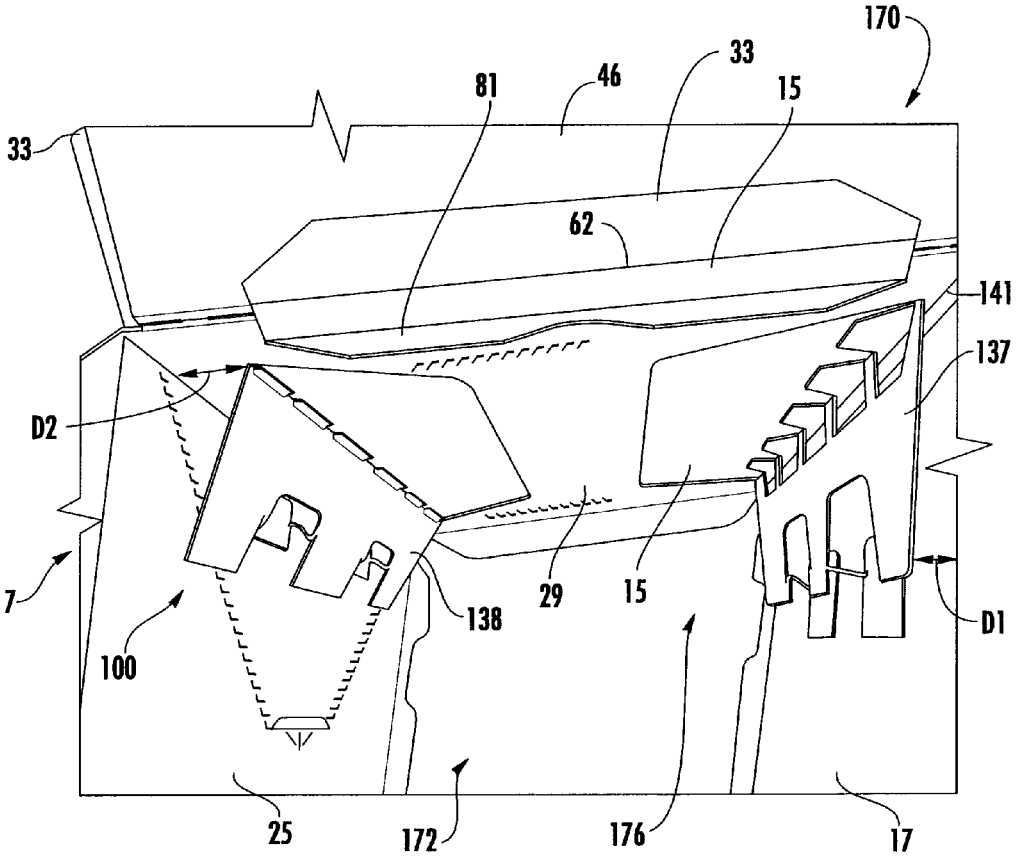

In accordance with the exemplary embodiment, the carton blank 3 can be further erected into the carton 5 by folding along fold lines 19, 23, 27, and 31 to form an open-ended sleeve 170 with an interior 172 (FIGS. 6 and 7). Containers C can be loaded into the interior 172 of the open-ended sleeve 170 (FIG. 7). In the illustrated embodiment, the crown retention panels 137, 138 can contact one or more of the containers C to help restrain the upper portions N of the respectively adjacent containers. In one embodiment, the containers C could be loaded before or after closing either or both of the ends 7, 9 of the carton. The sleeve 170 could be otherwise formed without departing from the scope of this disclosure.

Figure 8:
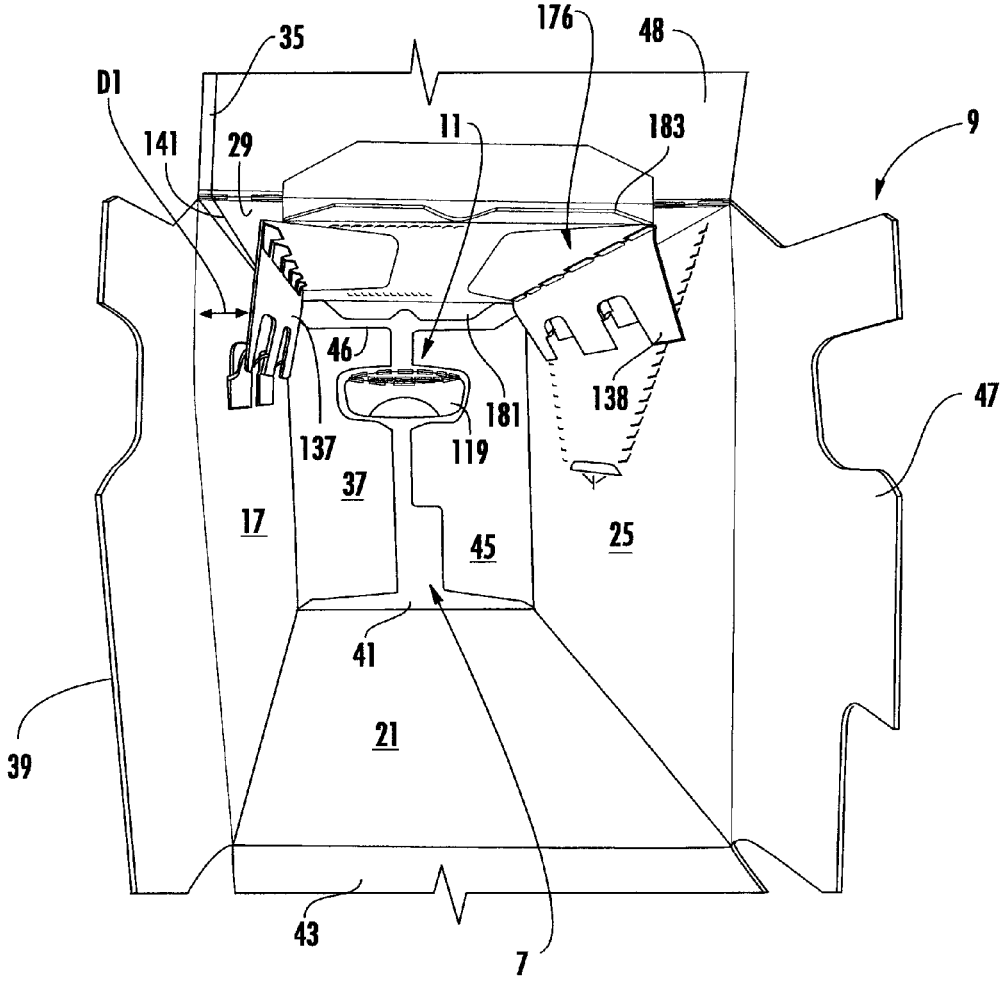

In the illustrated embodiment, as the open-ended sleeve 170 is formed and the side panels 17, 25 are folded with respect to the top panels 15, 29 (e.g., so that the side panels 17, 25 are generally vertical and the top panels 15, 29 are generally horizontal), the first crown retention panel 137 can at least partially separate from the second top panel 29 along the cut lines 143, 144 to extend at least partially into the interior 172 of the open-ended sleeve 170. Additionally, as the open-ended sleeve 170 is formed, the second crown retention panel 138 can fold along the lateral fold line 161 relative to the top panels 15, 29 and the second side panel 25 so that the second crown retention panel 138 is at least partially spaced apart from the second side panel 25. In the illustrated embodiment, the first crown retention panel 137 can extend generally parallel to the first side panel 17, and the second crown retention panel 138 can be oblique, extending from the top panels 15, 29 to the second side panel 25. As shown in FIGS. 6-8, the first crown retention panel 137 can fold along the lateral fold line 139, which is spaced apart from the first side panel 17 by the distance D1, and the connecting portions 149 can fold relative to the respective attachment flaps 145 and the first crown retention panel 137 to connect the first crown retention panel to the attachment flaps 145, which are adhered to the first side panel 17 and remain in face-to-face contact with the first side panel 17. In one embodiment, the attachment flaps 145 separate from the first crown retention flap 137 along the respective cut lines 155 and remain attached to the first side panel 17 (FIGS. 6 and 7) to help stabilize the first crown retention panel 137 in the interior 172.

Similarly, in the illustrated embodiment, the second crown retention panel 138 can fold along the lateral fold line 161, which is spaced apart from the second side panel 25 by the distance D2, and the connecting portions 169 can fold relative to the respective attachment flaps 165 and the second crown retention panel 138 to connect the second crown retention panel to the attachment flaps 165, which are adhered to the second side panel 25 and remain in face-to-face contact with the second side panel 25. In one embodiment, the attachment flaps 165 separate from the second crown retention flap 138 along the respective cut lines 175 and remain attached to the second side panel 25 (FIGS. 6 and 7) to help stabilize the second crown retention panel 138 in the interior 172.

In summary, in the configuration shown in FIG. 5, the first crown retention panel 137 is in face-to-face contact with the first side panel 17, with the attachment flaps 145 at least partially adhered to the first side panel 17. The first crown retention panel 137 is also in face-to-face contact with the first top panel 15 and planar with the second top panel 29 in FIG. 5. Also in FIG. 5, the second crown retention panel 138 is in face-to-face contact with the second side panel 25, with the attachment flaps 165 at least partially adhered to the second side panel 25. As the blank is folded along the lateral fold lines from the position in FIG. 5 to the position in FIGS. 6 and 7, the crown retention panels 137, 138 fold relative to the top panels 15, 29 and the side panels side panels 17, 25 so that the crown retention panels separate from the side panels 17, 25, and so that the first crown retention panel 137 separates from the top panels 15, 29. Accordingly, the crown retention panels 137, 138 are disposed in a position that is spaced apart from the respective side panels 17, 25 in the interior 172 of the open-ended sleeve 170. The crown retention panels 137, 138 could be otherwise positioned in the interior 172 of the carton 5 without departing from the scope of the disclosure. For example, the crown retention panels 137, 138 could be at least partially separated from the top panels 15, 29 and disposed in a position wherein the crown retention panels are spaced apart from the side panels 17, 25 in the interior 172, and the attachment flaps 145, 165 can be attached to the side panels 17, 25 after at least partially forming the open-ended sleeve 170.

As shown in FIG. 7, the crown retention panels 137, 138 can contact the upper portions N and/or caps CP of the containers C that are adjacent the respective side panels 17, 25 to help restrain the narrower upper portions N of the containers. The crown retention panels 137, 138 could be otherwise shaped, arranged, and/or configured without departing from the disclosure.

Figure 9:
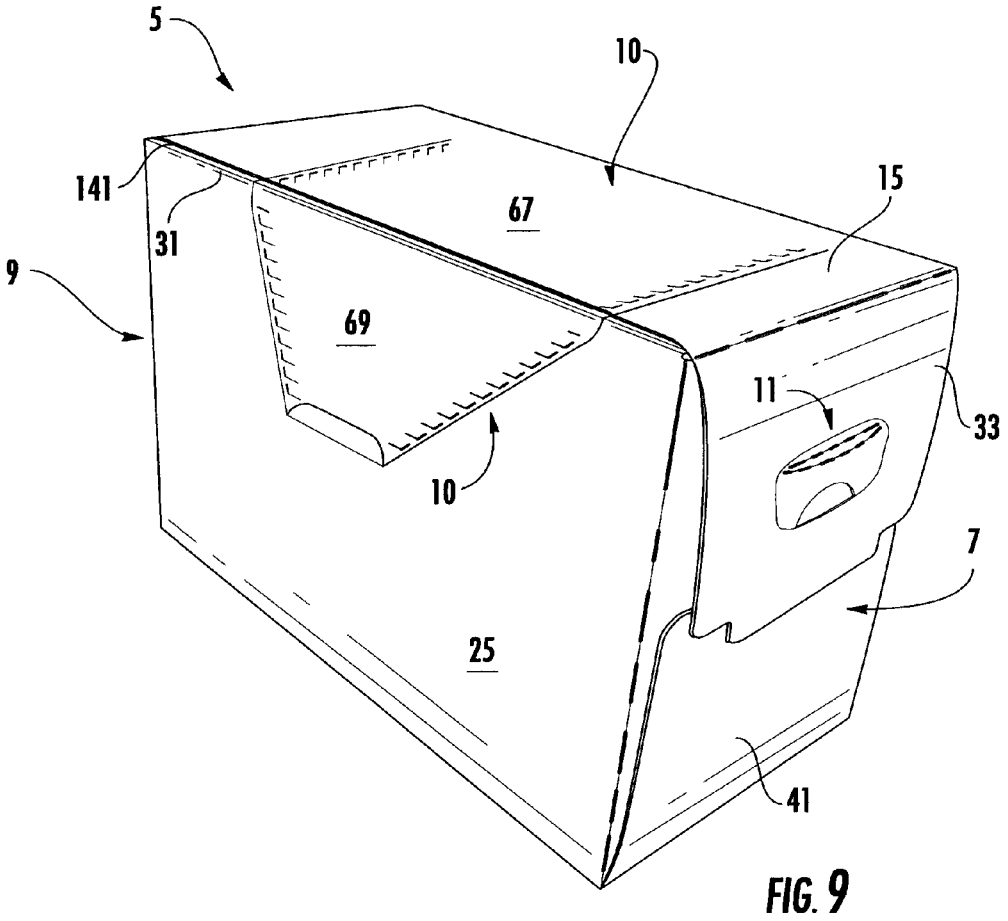
FIG. 9 is a perspective view of the erected carton according to the exemplary embodiment of the disclosure.

In one embodiment, the ends 7, 9 of the carton 5 can be closed as shown in FIGS. 8 and 9. The side end flaps 37, 45 can be inwardly folded to at least partially close the first end 7. In the exemplary embodiment, the top end flaps 33, 46 can be downwardly folded and the bottom end flap 41 can be upwardly folded to overlap the side end flaps 37, 45 and to further at least partially close the first end 7. As the overlapped top end flaps 33, 46 are folded downwardly over the end, the top end flap 33 can contact the first crown retention end flap 181 and cause the first crown retention end flap 181 to fold downwardly into the interior 172 of the carton. Accordingly, the first crown retention end flap 181 can extend obliquely from the top panels 17, 29 (at the longitudinal fold line 185, which is spaced apart from the closed end 7 by the distance D3) to the overlapped end flaps 33, 46, 37, 45. When the top end flaps 33, 46 overlap the side end flaps 37, 45, the inner and outer handle flaps 119, 49 are generally aligned with the cutouts 61 in the side end flaps to form the handle 11 (FIGS. 8 and 9). Accordingly, a user can grasp the carton 5 at the handle 11 by folding the handle flaps 49, 119 into the interior 172 of the carton to form a handle opening (not shown).

In the illustrated embodiment, the second end 9 can be closed in a similar or identical manner as the first end 7, and the handle 11 in the second end 9 can be formed in a similar manner as the handle 11 in the first end 7. Additionally, the second crown retention end flap 183 can be similarly positioned when the second end 9 of the carton 5 is closed. Accordingly, the crown retention end flaps 181, 183 can contact the upper portions N and/or caps CP of the containers C that are adjacent the respective closed ends 7, 9 to help restrain the narrower upper portions N of the containers. The crown retention end flaps 181, 183 could be otherwise shaped, arranged, and/or configured without departing from the disclosure. The first end 7 and/or the second end 9 could be closed by other steps without departing from the disclosure. For example, the crown retention end flaps 181, 183 could be manually folded with respect to the top panels 15, 29 and the end flaps before or after closing the ends 7, 9. Further, the handles 11 could be formed by other steps without departing from the disclosure.

The erected carton 5 according to the exemplary embodiment is shown in FIG. 9. In the exemplary embodiment, the crown retention panels 137, 138, the crown retention end flaps 181, 183, and/or other features can help provide an upper portion or crown area 176 (FIGS. 6-8) of the carton 5 that is smaller than the lower portion of the carton to help restrain the narrower upper portions N of the containers C. In one embodiment, the article protection flaps 13 in the bottom panel 21 also help restrain movement of the containers C.

In the illustrated embodiment, the dispenser 10 can be can be opened by tearing the dispensers panels 67, 69 away along the tear lines 71, 73, 75 to form a dispenser opening (not shown) in the top panels 15, 29 and the second side panel 25 of the carton 5. The tearing of the dispenser panel can be initiated, for example, at the access panel 77. In one embodiment, the second crown retention panel 138, which can be attached to the portion of the second dispenser panel 69 in the second side panel 25 via the attachment flaps 165, can be pulled out of the interior of the carton with the dispenser panels 67, 69 to help provide access to the containers C. The dispenser 10 could be otherwise actuated without departing from the disclosure.

Any of the features of the various embodiments of the disclosure can be combined with, replaced by, or otherwise configured with other features of other embodiments of the disclosure (and/or the disclosures that have been incorporated-by-reference) without departing from the scope of this disclosure. Further, it is noted that the reinforcing inserts, insert blanks, and/or crown retention features of the various embodiments can be incorporated into a carton having any carton style or panel configuration. The carton styles and panel configurations described above are included by way of example.

The blanks according to the present disclosure can be, for example, formed from coated paperboard and similar materials. For example, the interior and/or exterior sides of the blanks can be coated with a clay coating. The clay coating may then be printed over with product, advertising, price coding, and other information or images. The blanks may then be coated with a varnish to protect any information printed on the blank. The blanks may also be coated with, for example, a moisture barrier layer, on either or both sides of the blank. In accordance with the above-described embodiments, the blanks may be constructed of paperboard of a caliper such that it is heavier and more rigid than ordinary paper. The blanks can also be constructed of other materials, such as cardboard, hard paper, or any other material having properties suitable for enabling the carton to function at least generally as described herein. The blanks can also be laminated or coated with one or more sheet-like materials at selected panels or panel sections.

In accordance with the above-described embodiments of the present disclosure, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

The above embodiments may be described as having one or more panels adhered together by glue during erection of the carton embodiments. The term "glue" is intended to encompass all manner of adhesives commonly used to secure carton panels in place.

The foregoing description of the disclosure illustrates and describes various embodiments. As various changes could be made in the above construction without departing from the scope of the disclosure, it is intended that all matter contained in the above description or shown in the accompanying drawings shall be interpreted as illustrative and not in a limiting sense. Furthermore, the scope of the present disclosure covers various modifications, combinations, alterations, etc., of the above-described embodiments that are within the scope of the claims. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carton for holding a plurality of containers, the carton comprising:

a plurality of panels that extends at least partially around an interior of the carton, the plurality of panels comprises a first top panel, a second top panel, and a side panel, the first top panel at least partially overlapping the second top panel, wherein the second top panel extends at least partially along the interior of the carton, and the first top panel extends at least partially along an outer side of the second top panel; and a crown retention panel foldably connected to the second top panel along a fold line, an attachment flap being foldably connected to the crown retention panel;

wherein at least a portion of the crown retention panel is spaced apart from the side panel in the interior of the carton, a portion of the second top panel extends from the fold line toward the side panel, and at least a portion of the attachment flap is at least partially in face-to-face contact with the side panel.

2. The carton of claim 1, wherein the crown retention panel is positioned for contact with at least one container of the plurality of containers.

3. The carton of claim 1, wherein at least a portion of the crown retention panel is generally parallel to the side panel.

4. The carton of claim 1, wherein the attachment flap is a first attachment flap and the carton comprises a second attachment flap foldably connected to the crown retention panel.

5. The carton of claim 4, wherein two connecting portions extend from each of the first attachment flap and the second attachment flap to the crown retention panel in the interior of the carton.

6. The carton of claim 5, wherein at least a portion of each of the first attachment flap and the second attachment flap is at least partially attached in face-to-face contact to the side panel, and the two connecting portions extending from each of the first attachment flap and the second attachment flap extend generally horizontally in the interior of the carton.

7. The carton of claim 1, wherein a connecting portion extends from the attachment flap to the crown retention panel, at least partially connecting the attachment flap to the crown retention panel.

8. The carton of claim 7, wherein the attachment flap is at least partially attached in face-to-face contact to the side panel, and the connecting portion extends generally horizontally from the crown retention panel to the attachment flap in the interior of the carton.

9. The carton of claim 7, wherein the attachment flap comprises a first edge that is at least partially formed by a U-shaped cut in the crown retention panel and a second edge that is at least partially formed by a generally longitudinal cut in the crown retention panel.

10. The carton of claim 9, wherein the connecting portion is at least partially formed between generally parallel portions of the U-shaped cut and the longitudinal cut.

11. The carton of claim 10, wherein the connecting portion is a first connecting portion and the longitudinal cut is a first longitudinal cut, the attachment flap comprising a third edge that is at least partially formed by a second generally longitudinal cut in the crown retention panel, the second connecting portion being at least partially formed between generally parallel portions of the U-shaped cut and the second longitudinal cut.

12. The carton of claim 1, wherein the fold line is a lateral fold line that is spaced apart from an outer free edge of the second top panel, the crown retention panel extends generally downwardly from the lateral fold line.

13. The carton of claim 1, wherein the side panel is a first side panel, the carton further comprises a second side panel foldably connected to the second top panel along a lateral fold line, and the crown retention panel is spaced apart from an outer free edge of the second top panel and the lateral fold line.

14. The carton of claim 13, further comprising a dispenser comprising an outer tear line in at least the first top panel and a first inner tear line and a second inner tear line in at least the second top panel, each of the first inner tear line and the second inner tear line extending from an interior edge of the second top panel adjacent an opening in the second top panel formed by the crown retention panel.

15. The carton of claim 1, further comprising a dispenser comprising:

a first dispenser panel in the first top panel, the first dispenser panel comprising a first tear line in the first top panel;

a second dispenser panel in the side panel and the second top panel, the second dispenser panel comprising a second tear line in the side panel and a third tear line in the second top panel, the first dispenser panel at least partially overlapping the second dispenser panel.

16. The carton of claim 1, wherein the side panel is a first side panel, the crown retention panel is a first crown retention panel, the attachment flap is a first attachment flap, and the carton further comprises a second crown retention panel foldably connected to the second top panel, a second attachment flap being foldably connected to the second crown retention panel.

17. The carton of claim 16, wherein at least a portion of the second crown retention panel is spaced apart from the second side panel in the interior of the carton, and at least a portion of the second attachment flap is at least partially in face-to-face contact with the second side panel.

18. The carton of claim 1, further comprising a plurality of end flaps respectively foldably connected to respective panels of the plurality of panels, the plurality of end flaps being at least partially overlapped with respect to one another to thereby at least partially form a closed end of the carton, wherein a crown retention end flap is foldably connected to the second top panel proximate the closed end.

19. The carton of claim 18, wherein the plurality of end flaps comprises a first top end flap foldably connected to the first top panel and a second top end flap foldably connected to the second top panel, the first top end flap at least partially overlaps the second top end flap.

20. The carton of claim 19, wherein the crown retention end flap extends obliquely from the second top panel toward the closed end of the carton.

21. The carton of claim 19, wherein the crown retention end flap is foldably connected to the second top panel along a longitudinal fold line adjacent an opening in at least the second top panel and the second top end flap.

22. The carton of claim 19, further comprising a handle formed in the closed end of the carton, the handle comprising an outer handle flap foldably connected to the first top end flap and an inner handle flap foldably connected to the second top end flap, the outer handle flap at least partially overlapping the inner handle flap.

23. The carton of claim 1, wherein the second top panel comprises a free edge, and the portion of the second top panel extends from the fold line to the free edge so that the free edge is disposed proximate the side panel.

24. The carton of claim 1, wherein the fold line is a first fold line, the second top panel is foldably connected to the side panel along a second fold line, and the portion of the second top panel extends from the first fold line to the second fold line.

25. The carton of claim 1, wherein the side panel is a first side panel and the fold line is a first fold line, the first top panel is foldably connected to the first side panel along a second fold line, the plurality of panels further comprises a second side panel, and the second top panel is foldably connected to the second side panel along a third fold line.

26. The carton of claim 1, wherein the side panel is a first side panel and the fold line is a first fold line, the second top panel is foldably connected to the first side panel along a second fold line, the plurality of panels further comprises a second side panel, and the first top panel is foldably connected to the second side panel along a third fold line.

27. The carton of claim 26, wherein the crown retention panel is a first crown retention panel, the attachment flap is a first attachment flap, and the carton further comprises a second crown retention panel foldably connected to the second top panel, a second attachment flap being foldably connected to the second crown retention panel, wherein the second crown retention panel is spaced apart from the second side panel, and the second attachment flap is disposed at least partially in face-to-face contact with the second side panel.

28. A carton for holding a plurality of containers, the carton comprising:

a plurality of panels that extends at least partially around an interior of the carton, the plurality of panels comprises a first top panel, a second top panel, and a side panel, the first top panel at least partially overlapping the second top panel; and a crown retention panel foldably connected to the second top panel, an attachment flap being foldably connected to the crown retention panel, and a connecting portion at least partially connecting the attachment flap to the crown retention panel;

wherein at least a portion of the crown retention panel is spaced apart from the side panel in the interior of the carton, at least a portion of the attachment flap is at least partially in face-to-face contact with the side panel, the connecting portion extends from the attachment flap to the crown retention panel, and the connecting portion is spaced apart from a lowermost edge of the crown retention panel.

29. A carton for holding a plurality of containers, the carton comprising:

a plurality of panels that extends at least partially around an interior of the carton, the plurality of panels comprises a first top panel, a second top panel, and a side panel, the first top panel at least partially overlapping the second top panel;

a crown retention panel foldably connected to the second top panel, an attachment flap being foldably connected to the crown retention panel; and a dispenser comprising a first dispenser panel in the first top panel and a second dispenser panel in the side panel and the second top panel, the first dispenser panel comprising a first tear line in the first top panel, the second dispenser panel comprising a second tear line in the side panel and a third tear line in the second top panel, the first dispenser panel at least partially overlapping the second dispenser panel;

wherein at least a portion of the crown retention panel is spaced apart from the side panel in the interior of the carton, and at least a portion of the attachment flap is at least partially in face-to-face contact with the side panel;

wherein the first dispenser panel and the second dispenser panel are for being folded upwardly when the dispenser is actuated, and the attachment flap is at least partially attached to a portion of the second dispenser panel in the side panel so that the attachment flap and the crown retention panel are folded upwardly with the first dispenser panel and the second dispenser panel when the dispenser is actuated.

30. A blank for forming a carton for holding a plurality of containers, the blank comprising:

a plurality of panels comprising a first top panel, a second top panel, a first side panel, and a second side panel, the second top panel being foldably connected to the second side panel along a first fold line, the second top panel having a free edge disposed opposite to the first fold line, and the first top panel at least partially overlapping the second top panel so that the second top panel extends along an interior side of the blank and the first top panel extends at least partially along an outer side of the second top panel; and a crown retention panel foldably connected to the second top panel along a second fold line, a portion of the second top panel extending from the second fold line to one of the first fold line and the free edge of the second top panel, an attachment flap being foldably connected to the crown retention panel;

wherein at least a portion of the crown retention panel is for being disposed in a position that is spaced apart from the first side panel and the second side panel when the carton is formed from the blank, at least a portion of the attachment flap is for being disposed at least partially in face-to-face contact with one of the first side panel and the second side panel when the carton is formed from the blank, and the portion of the second top panel is for extending from the second fold line toward the one of the first side panel and the second side panel when the carton is formed from the blank.

31. The blank of claim 30, wherein the crown retention panel is for being positioned for contact with at least one container of the plurality of containers when the carton is formed from the blank.

32. The blank of claim 30, wherein at least a portion of the crown retention panel is in face-to-face contact with the first top panel.

33. The blank of claim 32, wherein at least a portion of the crown retention panel is separable from the second top panel along a cut line.

34. The blank of claim 30, wherein the attachment flap is a first attachment flap and the blank comprises a second attachment flap foldably connected to the crown retention panel.

35. The blank of claim 34, wherein each of the first attachment flap and the second attachment flap comprises two connecting portions that are connected to the crown retention panel.

36. The blank of claim 30, wherein the attachment flap is connected to the crown retention panel by a connecting portion.

37. The blank of claim 36, wherein the attachment flap is at least partially separable from the crown retention panel along a U-shaped cut line.

38. The blank of claim 37, wherein the crown retention panel is at least partially separable from the second top panel along a first cut line, the attachment flap is at least partially separable from the second top panel along a second cut line, the first cut line is generally collinear with the second cut line, and the U-shaped cut line is spaced apart from the first cut line and the second cut line.

39. The blank of claim 36, wherein the attachment flap is at least partially separable from the crown retention panel along a U-shaped cut line and by a generally longitudinal cut line, and at least a portion of the connecting portion is defined between the U-shaped cut line and the generally longitudinal cut line.

40. The blank of claim 39, wherein the crown retention panel is at least partially separable from the second top panel along a cut line, the U-shaped cut line is spaced apart from the cut line, and the generally longitudinal cut line extends from the cut line.

41. The blank of claim 39, wherein the connecting portion is a first connecting portion and the generally longitudinal cut line is a first generally longitudinal cut line, the attachment flap being at least partially separable from the crown retention panel along a second generally longitudinal cut line, the second connecting portion being at least partially defined between the U-shaped cut line and the second generally longitudinal cut line.

42. The blank of claim 30, wherein the second fold line is a lateral fold line that is spaced apart from the free edge of the second top panel, and at least a portion of the crown retention panel is separable from the second top panel along a cut line that extends away from the free edge of the second top panel.

43. The blank of claim 30, wherein the second side panel is foldably connected to the second top panel along the first fold line, the first fold line is a lateral fold line, and the crown retention panel is spaced apart from the free edge of the second top panel and the lateral fold line.

44. The blank of claim 43, further comprising a dispenser comprising an outer tear line in at least the first top panel and a first inner tear line and a second inner tear line in at least the second top panel, the crown retention panel is at least partially separable from the second top panel along a cut line, and each of the first inner tear line and the second inner tear line extend from the cut line.

45. The blank of claim 30, further comprising a dispenser comprising:

a first dispenser panel in the first top panel, the first dispenser panel comprising a first tear line in the first top panel;

a second dispenser panel in the second top panel and in at least one of the first side panel and the second side panel, the second dispenser panel comprising a second tear line in the at least one of the first side panel and the second side panel and a third tear line in the second top panel, the first dispenser panel at least partially overlapping the second dispenser panel.

46. The blank of claim 30, wherein the crown retention panel is a first crown retention panel, the attachment flap is a first attachment flap, and the blank further comprises a second crown retention panel foldably connected to the second top panel, a second attachment flap being foldably connected to the second crown retention panel.

47. The blank of claim 46, wherein at least a portion of the second crown retention panel is spaced apart from the second side panel in the interior of the carton formed from the blank, at least a portion of the first attachment flap is for being disposed at least partially in face-to-face contact with the first side panel when the carton is foamed from the blank, and at least a portion of the second attachment flap is for being disposed at least partially in face-to-face contact with the second side panel when the carton is formed from the blank.

48. The blank of claim 30, further comprising a plurality of end flaps respectively foldably connected to respective panels of the plurality of panels, the plurality of end flaps comprising a first top end flap foldably connected to the first top panel, wherein a crown retention end flap is foldably connected to the second top panel, and the first top end flap at least partially overlaps the crown retention end flap.

49. The blank of claim 48, wherein the plurality of end flaps comprises a second top end flap foldably connected to the second top panel, and the first top end flap at least partially overlaps the second top end flap.

50. The blank of claim 49, wherein the crown retention end flap is foldably connected to the second top panel along a longitudinal fold line, and the crown retention end flap extends adjacent an opening in at least the second top panel and the second top end flap.

51. The blank of claim 30, wherein the free edge of the second top panel is for being disposed proximate the first side panel when the carton is formed from the blank, the portion of the second top panel extends from the second fold line to the free edge, and the attachment flap is for being disposed at least partially in face-to-face contact with the first side panel when the carton is formed from the blank.

52. The blank of claim 51, wherein the crown retention panel is a first crown retention panel, the attachment flap is a first attachment flap, and the blank further comprises a second crown retention panel foldably connected to the second top panel, a second attachment flap being foldably connected to the second crown retention panel, wherein the second attachment flap is for being disposed at least partially in face-to-face contact with the second side panel when the carton is formed from the blank.

53. The blank of claim 30, wherein the portion of the second top panel extends from the second fold line to the first fold line, and the attachment flap is for being disposed at least partially in face-to-face contact with the second side panel when the carton is formed from the blank.

54. The blank of claim 30, wherein the first top panel is foldably connected to the first side panel along a third fold line.

55. A method of forming a carton comprising:

obtaining a blank comprising a plurality of panels comprising a first top panel, a second top panel, a side panel, a crown retention panel foldably connected to the second top panel along a fold line, and an attachment flap foldably connected to the crown retention panel;

folding the blank so that the crown retention panel is at least partially in face-to-face contact with the side panel and at least partially affixing the attachment flap to the side panel;

positioning the first top panel to at least partially overlap the second top panel; and forming an interior of the carton at least partially defined by the plurality of panels, the forming the interior of the carton comprising forming an open-ended sleeve, and the forming the interior of the carton causing the crown retention panel to fold relative to the second top panel and to be disposed in a position that is spaced apart from the side panel in the interior of the carton, a portion of the second top panel extending from the fold line toward the side panel, wherein the second top panel extends at least partially along the interior of the carton, and the first top panel extends at least partially along an outer side of the second top panel.

56. The method of claim 55, further comprising loading the plurality of containers into the interior of the carton, at least one of the containers of the plurality of containers contacting the crown retention panel.

57. The method of claim 55, wherein the folding the blank comprising folding the crown retention panel along the fold line relative to the second top panel and against the side panel.

58. The method of claim 57, wherein the side panel is a second side panel, the first top panel is foldably connected to a first side panel, the second top panel is foldably connected to the second side panel, the folding the blank further comprises positioning the second top panel at least partially in face-to-face contact with the first side panel.

59. The method of claim 58, wherein the crown retention panel is a first crown retention panel, the attachment flap is a first attachment flap, a second crown retention panel is foldably connected to the second top panel, a second attachment flap is foldably connected to the second crown retention panel, and the positioning the second top panel at least partially in face-to-face contact with the first side panel comprises positioning the second crown retention panel at least partially in face-to-face contact with the first side panel and at least partially affixing the second attachment flap to the first side panel.

60. The method of claim 55, wherein the first top panel is foldably connected to the side panel, and the folding the blank so that the crown retention panel is at least partially in face-to-face contact with the side panel comprises positioning the second top panel to be at least partially in face-to-face contact with the side panel.

61. The method of claim 55, wherein the fold line is a lateral fold line that is spaced apart from the side panel, and at least a portion of the crown retention panel is separable from the second top panel along a cut line that extends away from the side panel, the forming the interior of the carton causing the crown retention panel to at least partially separate from the second top panel along the cut line as the crown retention panel is folded relative to the second top panel.

* * * * *